US005943994A

United States Patent [19]

Hosoi et al.

[11] Patent Number: 5,943,994

[45] Date of Patent: Aug. 31, 1999

[54] V-SHAPED ENGINE FUEL DISTRIBUTOR PIPE

[75] Inventors: Shigehito Hosoi, Atsugi; Eriko Kimura, Yokohama, both of Japan

[73] Assignee: Nissan Motor Co., Ltd., Kanagawa, Japan

[21] Appl. No.: 08/883,325

[22] Filed: Jun. 26, 1997

[30] Foreign Application Priority Data

Jun. 28, 1996 [JP] Japan ..... 8-170499

[51] Int. Cl.[6] ..... F02M 55/02

[52] U.S. Cl. ..... 123/468; 123/456

[58] Field of Search ..... 123/456, 468, 123/469, 470

[56] References Cited

U.S. PATENT DOCUMENTS

| | | | |
|---|---|---|---|
| 4,586,477 | 5/1986 | Field et al. | 123/468 |
| 5,002,030 | 3/1991 | Mahnke | 123/469 |
| 5,197,436 | 3/1993 | Ozawa | 123/456 |
| 5,445,130 | 8/1995 | Brummer et al. | 123/456 |
| 5,511,527 | 4/1996 | Lorraine | 123/456 |

FOREIGN PATENT DOCUMENTS

| | | |
|---|---|---|
| 2-59252 | 4/1990 | Japan . |
| 2-59259 | 4/1990 | Japan . |
| 6-73372 | 10/1994 | Japan . |

*Primary Examiner*—Thomas N. Moulis
*Attorney, Agent, or Firm*—McDermott, Will & Emery

[57] ABSTRACT

A fuel distributor pipe for supplying fuel to two cylinder banks of a V-shaped engine comprises main pipes of metal construction which are respectively fixed substantially horizontally with respect to the cylinder banks, and a sub-pipe of metal construction which connects the main pipes. The sub-pipe comprises three curved portions in a vertical plane comprising two convex portions and one concave portion situated therebetween. When there is an error in the vertical direction of the position of connecting parts between the sub-pipe and main pipes, these curved portions disperse the stress due to the error, and concentration of stress in the connecting parts is avoided.

7 Claims, 6 Drawing Sheets

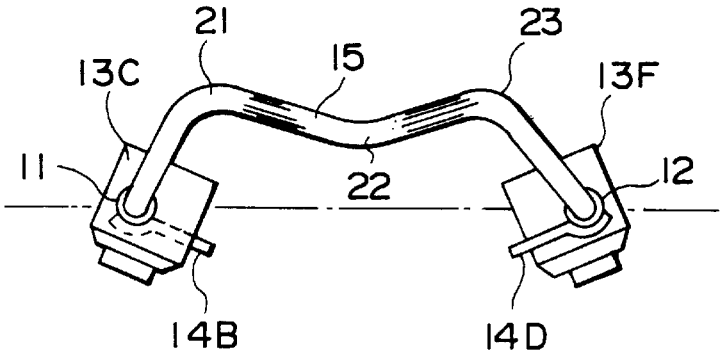
FIG. 2
FIG. 3A
FIG. 3B
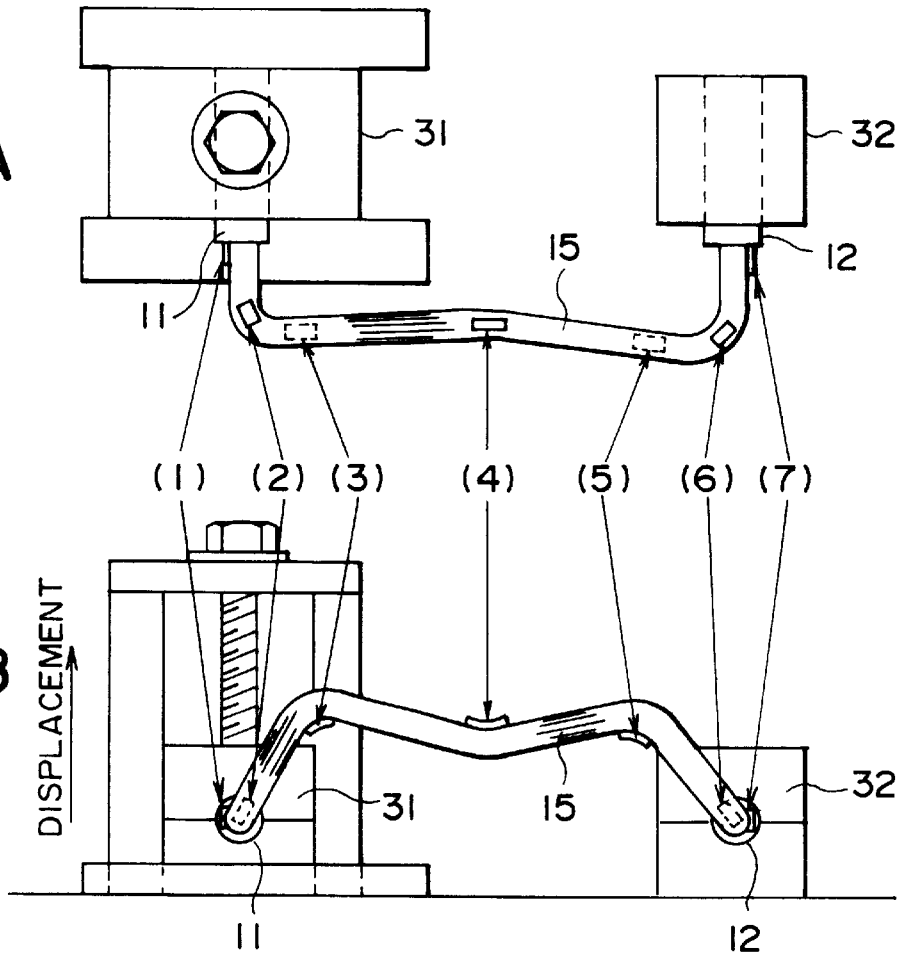

V-SHAPED ENGINE FUEL DISTRIBUTOR PIPE

FIELD OF THE INVENTION

This invention relates to a fuel distributor pipe which supplies fuel to two V-shaped engine cylinder banks.

BACKGROUND OF THE INVENTION

A fuel distributor pipe for supplying fuel to a V-shaped engine having two cylinder banks comprises for example a main pipe provided for each cylinder bank and a sub-pipe connecting these main pipes.

Each main pipe is made of metal tubing and has fuel supply ports for supplying fuel to fuel injectors in cylinders in each bank.

Fuel supplied to one of the main pipes from a pump is circulated to the other main pipe via the sub-pipe and supplied to the fuel injectors from these ports. Excess fuel is recovered in a fuel tank via a fuel return pipe connected to one end of the other main pipe. A pressure regulator for maintaining constant fuel pressure is interposed therebetween.

The above fuel distributor pipe construction is disclosed for example in Jikkai Hei 2-59252 and Jikkai Hei 2-59259 published in 1990, and in Jikkai Hei 6-73372 published in 1994, by the Japanese Patent Office.

However in this type of distributor pipe arrangement, there may be a minute difference in the heights of the main pipes due to a dimensional tolerance error of the two cylinder banks in a vertical direction, and this tends to cause stress in connections between the main pipes and sub-pipe when the sub-pipe is constructed with metal tubing.

The dimensional error may be absorbed by using eye joints in the connections, but this leads to an increase of parts and makes the cost of manufacturing the fuel distributor pipe higher.

When rubber hose is used for the sub-pipes stress is not produced in the connections, however this requires clamps to prevent the hose from becoming detached which still leads to more parts and higher cost.

SUMMARY OF THE INVENTION

It is therefore an object of the invention to reduce stress produced in the connection between a main pipe and a sub-pipe without increasing a number of parts.

It is a further object of the invention to reduce the manufacturing cost of a fuel distributor pipe system.

In order to achieve the above objects, this invention provides a fuel distributor pipe for supplying fuel to two cylinder banks of a V-shaped engine. The fuel distributor pipe comprises two main pipes of metal construction both fixed substantially horizontally to the engine, and a sub-pipe of metal construction. The sub-pipe has two ends which form connecting parts connected to the main pipes and comprises curved portions in a vertical plane at three positions comprising two convex portions and one concave portion situated therebetween.

It is preferable that the sub-pipe further comprises a curved portion in a horizontal direction which is continuous with one of the connecting parts, and the one of the connecting parts is inserted into one of the main pipes.

It is also preferable that the sub-pipe is of smaller diameter and lower rigidity than the main pipes.

It is also preferable that the connecting parts are fixed to the main pipes by welding.

It is also preferable that the concave portion also has a horizontal curvature.

It is also preferable that the curvature radii of the convex and concave portions lie within the range 12–15 mm.

It is also preferable that an opening is formed on an outer circumference of one of the main pipes and one of the connecting parts is connected to the one of the main pipes via the opening.

The details as well as other features and advantages of this invention are set forth in the remainder of the specification and are shown in the accompanying drawings.

BRIEF DESCRIPTION OF THE DRAWINGS

FIG. 2 is a cross-sectional view of the fuel distributor pipe taken along line II—II in FIG. 1.

FIGS. 3A and 3B are plan and lateral views of the fuel distributor pipe set in a stress tester.

DESCRIPTION OF THE PREFERRED EMBODIMENTS

Figure 1:
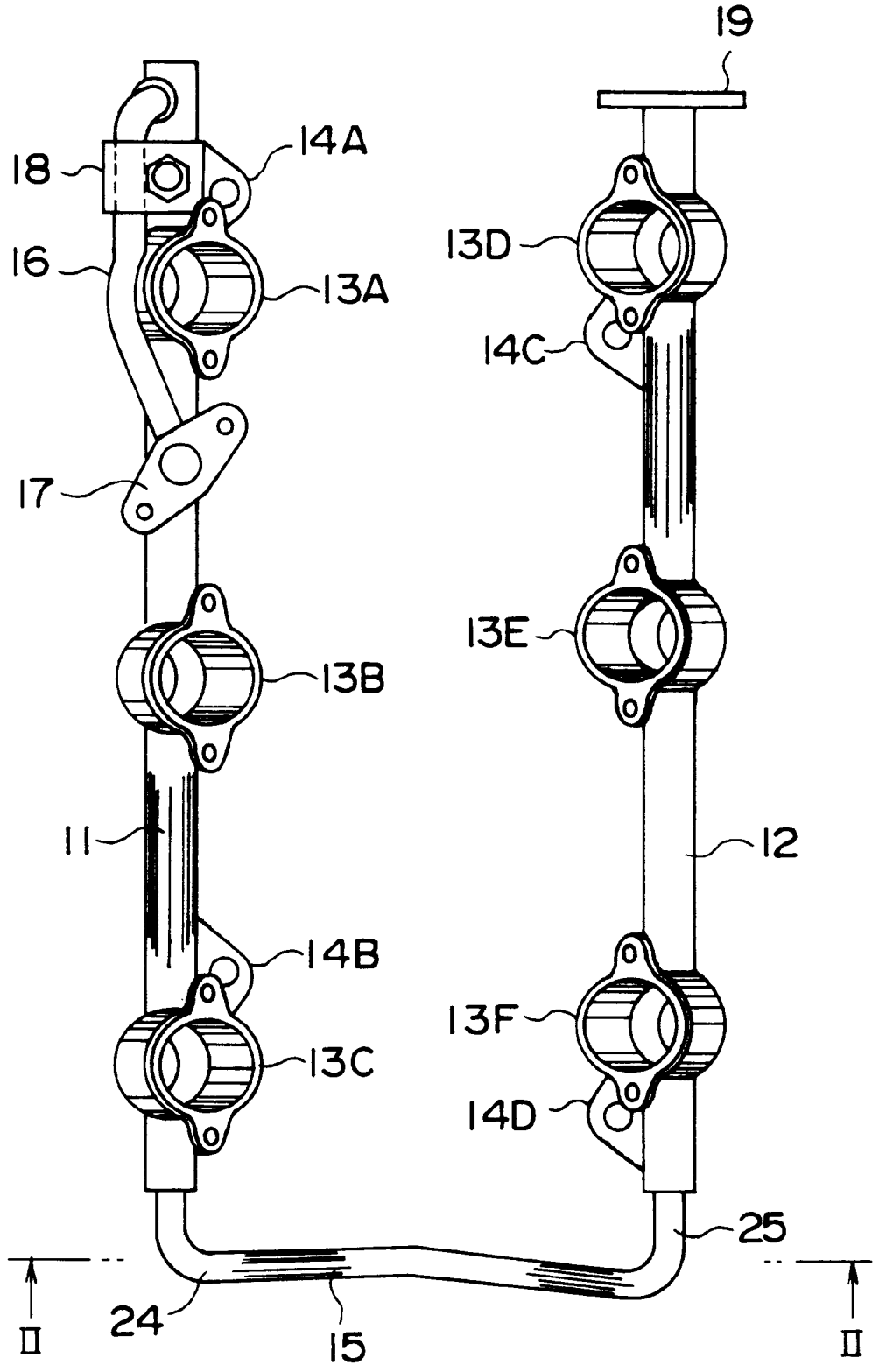
FIG. 1 is a plan view of a fuel distributor pipe according to a first embodiment of this invention.

Referring to FIG. 1 of the drawings, a fuel distribution pipe for supplying fuel to a V-shaped six cylinder engine comprises main pipes 11, 12 disposed along cylinder banks and a sub-pipe 15 connecting the main pipes.

A guide pipe 16 is connected to one end of the main pipe 11. A pipe for supplying fuel from a fuel pump, not shown, is connected to an opening 17 with a flange in this guide pipe 16. The guide pipe 16 is fixed to the main pipe 11 by a clamp 18.

A pressure regulator, not shown, which maintains fuel pressure within fixed limits is connected to one end of the main pipe 12 via a flange 19.

A fuel return pipe for recycling excess fuel in the fuel distributor pipe to a fuel tank is also connected to the pressure regulator.

Holders 13A–13C for fixing the injectors of three cylinders are installed in the main pipe 11. Likewise, holders 13D–13F for fixing the injectors of the other three cylinders are installed in the main pipe 12.

The main pipes 11, 12 are constructed of metal tubing.

The main pipe 11 is fixed to an intake manifold which supplies air to one of the cylinder banks by brackets 14A, 14B. The main pipe 12 is fixed to another intake manifold which supplies air to the other cylinder bank by brackets 14C, 14D.

Figure 7:
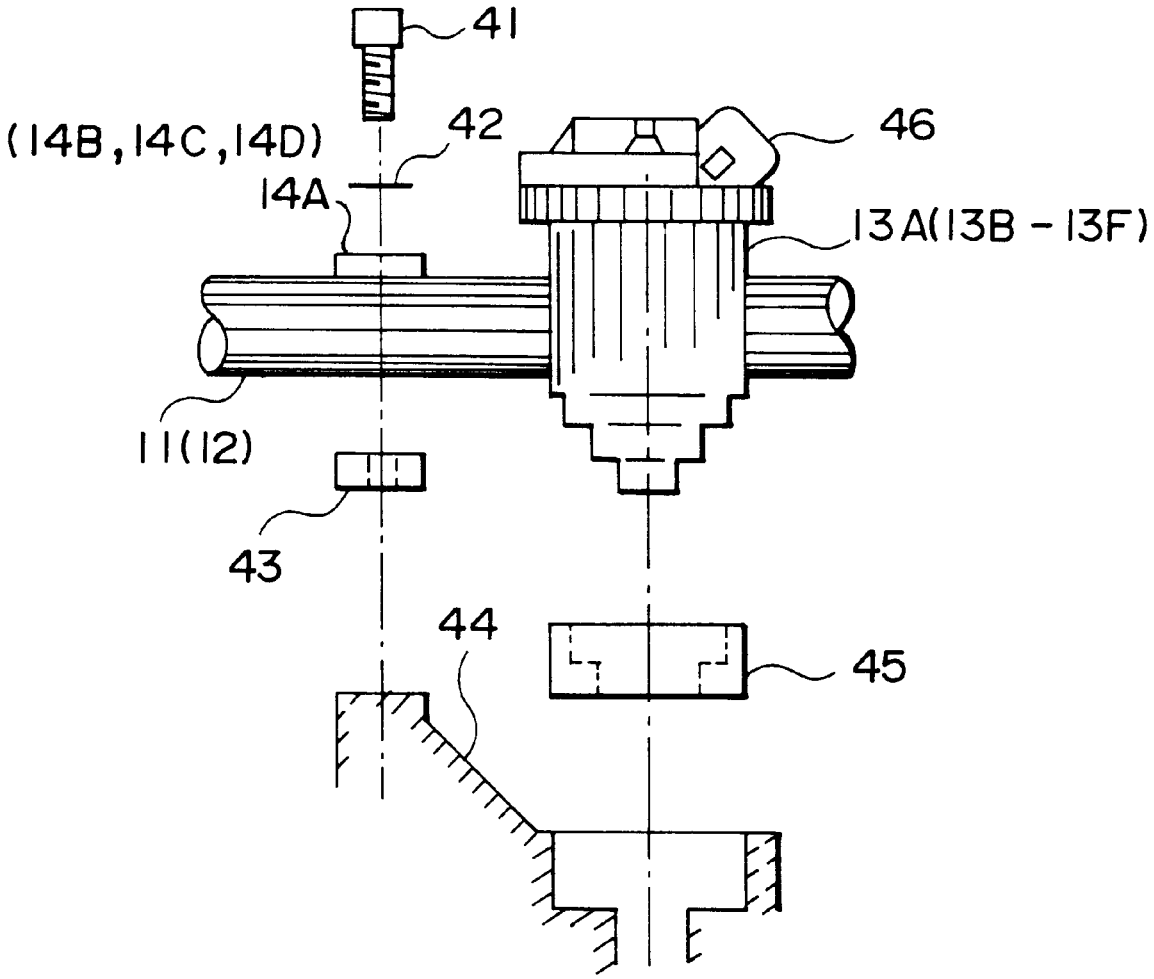

The fixation of main pipes 11 and 12 are shown in detail in FIG. 7.

In this figure the main pipe 11 (12) is screwed on to the intake manifold 44 by a bolt 41 which passes through a washer 42, the bracket 14A (14B, 14C, 14D) and a spacer 43. An fuel injector 46 which is held by holders 13A (13B–13F) is also fitted to the intake manifold 44 via a rubber insulator 45.

The sub-pipe 15 is also constructed of metal tubing, but it has a smaller diameter and is less rigid than the main pipes 11, 12.

Next, referring to FIG. 2 of the drawings, the sub-pipe 15 comprises three curved portions 21–23 in a perpendicular plane. The central curved portion 22 is concave, and the two lateral curved portions 21, 23 are convex. The sub-pipe 15 therefore has a substantially "M" shape in a vertical plane. The radii of curvature of these curved portions 21–23 are set at 12–15 mm.

Elbow-shaped curved portions 24, 25 which are bent at substantially 90 degrees in a horizontal direction as shown in FIG. 1 are further provided at both ends of the sub-pipe 15. These curved portions 24, 25 are respectively inserted in the main pipes 11, 12, and are fixed by welding.

As shown in FIG. 1, the sub-pipe 15 is bent in a horizontal direction in its center part so that the curved portion 22 slightly projects above the figure.

Due to the aforesaid construction, even when an error occurs in the fixing height of the main pipes 11, 12 as a result of left/right bank dimensional errors in an up/down direction, in the sub-pipe 15, internal stress due to these errors is dispersed by the curved portions 21–23.

Internal stress due to errors in a horizontal arrangement of the main pipes 11, 12 is dispersed by the curved portions 24, 25 as well as by the horizontal curvature of the curved portion 22.

Hence, stress does not concentrate in connecting parts, and stress produced in the connecting parts of the main pipes 11, 12 is reduced. Also by welding these connecting parts, the number of parts required for the fuel distributor pipe is reduced and the cost of installing the pipe is reduced.

Next, experimental results obtained by the inventors using the aforesaid fuel distributor pipe will be described.

In this experiment, the main pipe 11 to which one end of the sub-pipe 15 was welded was fixed to a movable chuck 31, and the main pipe 12 to which the other end of the sub-pipe 15 was welded was fixed to a fixed chuck 32.

Strain gauges (1)–(7) were attached to the main parts of the sub-pipe 15. The strain gauges (1) and (7) were disposed at the ends of the sub-pipe 15, and the strain gauges (2)–(6) were disposed inside the curves of the curved portions 21–25.

Figure 4:
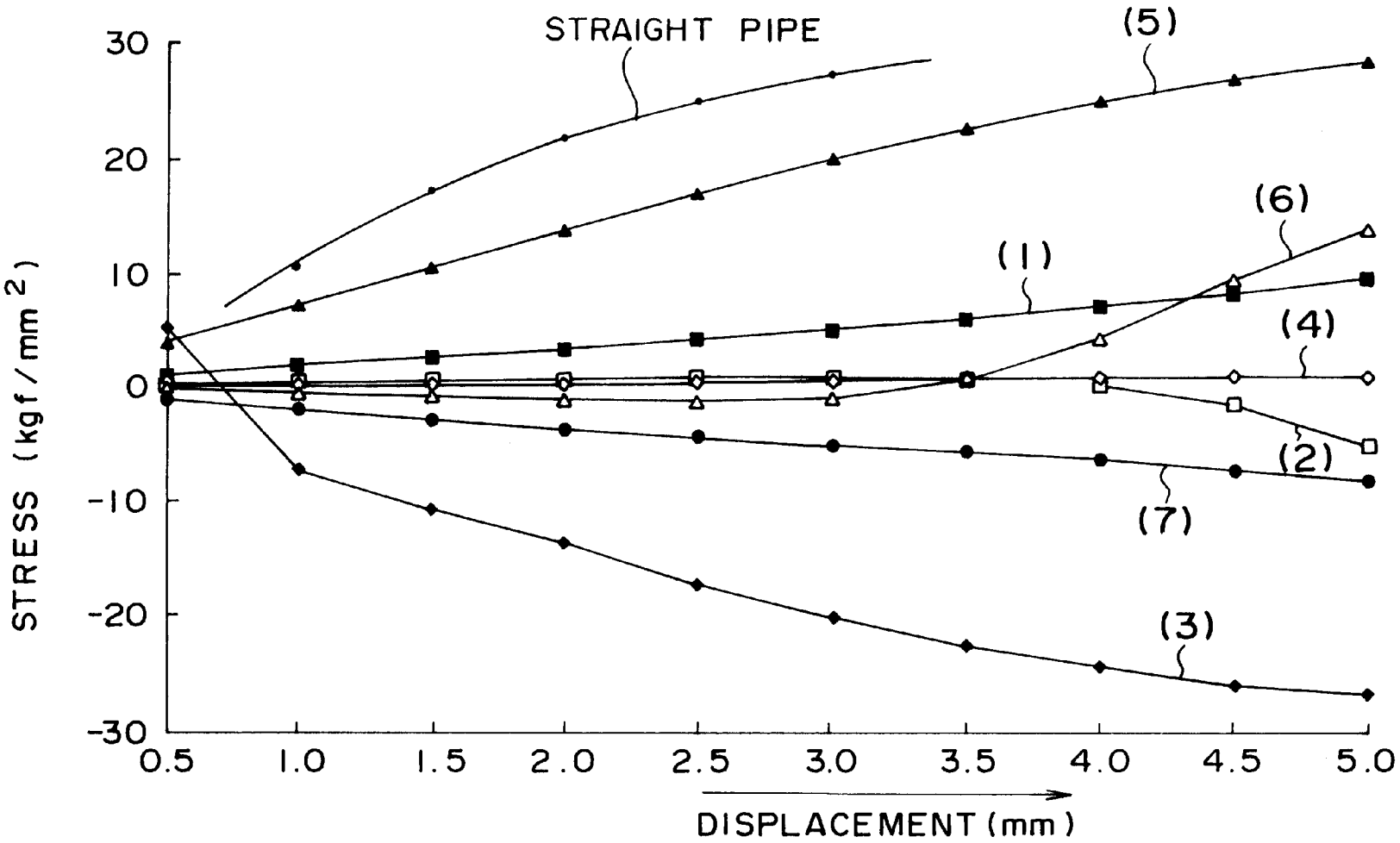
FIG. 4 is a graph showing a relation between a displacement of the fuel distributor pipe and stress produced in various parts thereof.

In this state, the movable chuck 31 was displaced in an up/down direction, and the static stress of each part was measured by the strain gauges. The measured results are shown in graphical form in FIG. 4. The graph marked "straight pipe"0 shows the stress of each part when the main pipes 11, 12 are joined by a sub-pipe of the same length as that of the sub-pipe 15 but having no curves.

According to this graph the stress detected by the strain gauge (5), corresponding to the curved part 23 in the sub-pipe 15, is the largest, but the stress in all parts of the sub-pipe 15 is less than the stress in the straight pipe.

When the displacement of the movable chuck 31 is 1 mm, the maximum stress in the straight pipe is 11.4 kgf/mm$^2$, but the maximum stress in the sub-pipe 15 is only 7.392 kgf/mm$^2$. This means a stress reduction of 35% was achieved by this invention.

Likewise, when the displacement of the movable chuck 31 is 2 mm, the maximum stress in the straight pipe is 22.9 kgflmm$^2$, but the maximum stress in the sub-pipe 15 is only 13.965 kgf/mm$^2$. This corresponds to a stress reduction of 39%.

In order to better disperse the stress, the curvature radius of the curved portions should be small. It is therefore preferable that the curvature radius is 15 mm or less, however as the pipe is flattened when it is sharply bent which interferes with fuel flow, the radius cannot be made too small.

The inventors measured the flattening of curvature radius for a pipe of outer diameter 8 mm and thickness 0.7 mm. Flattening is expressed as (1-d/D)×100 (%) where the original outer diameter is D, and the outer diameter in the short diameter direction of a flat pipe cross-section after bending is d. The following results were obtained by experiment.

R=10 mm, flattening=19% or higher

R=12 mm, flattening=14–19%

R=18 mm, flattening=9–12%

R=20 mm, flattening=8–9% where R is the curvature radius of the curved portion.

Hence, the flattening increases the smaller the curvature radius, however when the flattening exceeds 20%, pressure loss increases and fuel no longer flows smoothly. In general, the pressure regulator adjusts the fuel pressure at the end of the fuel distributor pipe. In order to adjust the fuel pressure to for example 3 kgf/mm$^2$ by the pressure regulator, the fuel pump has to supply a higher discharge pressure. In this case, since the pressure drops at the curved portions, the fuel pressure is different upstream and downstream of the curved portions, and scatter is produced in the injection amount of the fuel injector. It is thus necessary to determine the curvature radius such that the flattening does not exceed 20%. This corresponds to a curvature radius R =12 mm, and it is therefore preferable that the curvature radius R lies within the range 12–15 mm.

Figure 5:
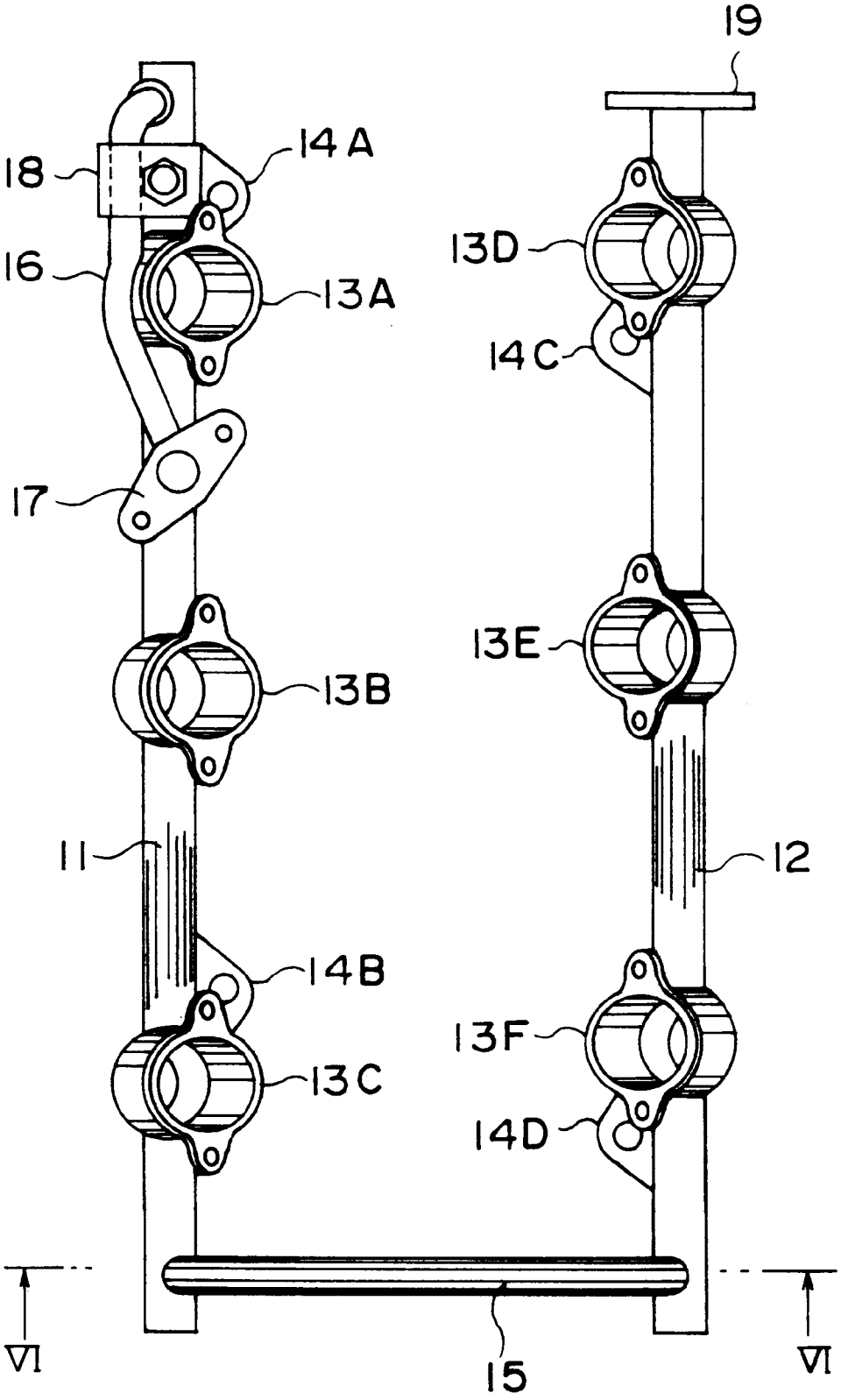
FIG. 5 is a plan view of a fuel distributor pipe according to a second embodiment of this invention.
Figure 6:
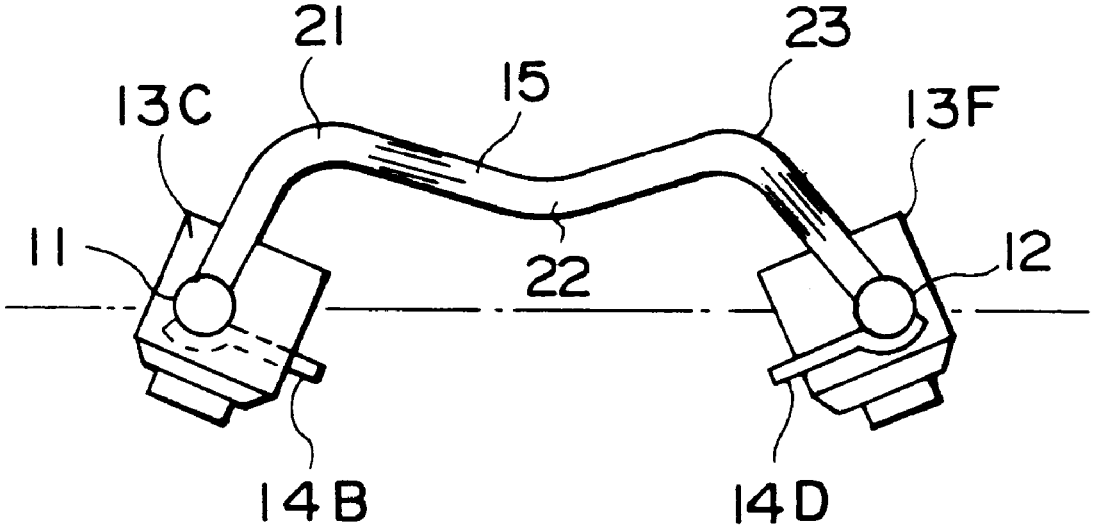
FIG. 6 is a cross-sectional view of the fuel distributor pipe according to the second embodiment taken along line VI—VI in FIG. 5.

FIGS. 5 and 6 show another embodiment of this invention.

According to this embodiment, instead of providing the curved portions 24, 25 at the two ends of the sub-pipe 15, these parts comprise straight pipes which are joined to apertures formed in the sides of the main pipes 11, 12.

According to this embodiment, the number of curved portions is less than in the aforesaid first embodiment. This is disadvantageous from the viewpoint of stress dispersion, but the effect of this invention can still be obtained.

The embodiments of this invention in which an exclusive property or privilege is claimed are defined as follows:

1. A fuel distributor pipe for supplying fuel to two cylinder banks of a V-shaped engine, comprising:

two main pipes of metal construction both fixed substantially horizontally to the engine, and a sub-pipe of metal construction, said sub-pipe having two ends which form connecting parts connected to said main pipes, wherein:

said sub-pipe comprises curved portions in a vertical plane at three positions comprising two convex portions and one concave portion situated therebetween.

2. A fuel distributor pipe as defined in claim 1, wherein said sub-pipe further comprises a curved portion in a horizontal direction which is continuous with one of said connecting parts, and said one of said connecting parts is inserted into one of said main pipes.

3. A fuel distributor pipe as defined in claim 1, wherein said sub-pipe is of smaller diameter and lower rigidity than said main pipes.

4. A fuel distributor pipe as defined in claim 1, wherein said connecting parts are fixed to said main pipes by welding.

5. A fuel distributor pipe as defined in claim 1, wherein said concave portion also has a horizontal curvature.

6. A fuel distributor pipe as defined in claim 1, wherein curvature radii of said convex and concave portions lie within the range 12–15 mm.

7. A fuel distributor pipe as defined in claim 1, wherein an opening is formed on an outer circumference of one of said main pipes and one of said connecting parts is connected to said one of said main pipes via said opening.

* * * * *